United States Patent [19]

Santefort

[11] 4,208,236

[45] Jun. 17, 1980

[54] GLUE APPLICATION APPARATUS FOR USE WITH CAN LABELING MACHINES AND THE LIKE

[75] Inventor: Richard A. Santefort, South Holland, Ill.

[73] Assignee: Valco Cincinnati, Inc., Cincinnati, Ohio

[21] Appl. No.: 971,314

[22] Filed: Dec. 20, 1978

[51] Int. Cl.[2] ..... B65C 9/04

[52] U.S. Cl. ..... 156/356; 156/453; 156/455

[58] Field of Search ..... 156/453, 455, 356, 357, 156/578; 118/411, 410, 412

[56] References Cited

U.S. PATENT DOCUMENTS

| | | | |
|---|---|---|---|
| 1,835,145 | 12/1931 | Cooke | 156/356 |
| 1,864,288 | 6/1932 | Wild | 156/453 X |
| 2,171,085 | 8/1939 | Friberg | 156/453 X |
| 3,017,311 | 1/1962 | Mattingly et al. | 156/453 X |
| 3,560,303 | 2/1971 | Nelson | 156/455 X |
| 3,905,329 | 9/1975 | Cone et al. | 118/411 X |

*Primary Examiner*—David A. Simmons
*Attorney, Agent, or Firm*—Frost & Jacobs

[57] ABSTRACT

In a labeling machine for cylindrical objects such as cans, having conventional means to apply glue to such object in a line parallel to the axis thereof, and having means for causing the object to roll over a stack of labels such that one end of the uppermost label in the stack is picked up by adhering to said line of glue, and is rolled around the object as it progresses in its rolling path; means are disclosed to apply a line of glue under pressure to the uppermost label in the stack at its trailing end in timed relation to the movement of the object in its path so that the trailing edge of the label adheres to the object as it continues its rolling path. Means are provided to adjust for objects of varying length and diameter, and for labels of different lengths.

6 Claims, 5 Drawing Figures

GLUE APPLICATION APPARATUS FOR USE WITH CAN LABELING MACHINES AND THE LIKE

BRIEF SUMMARY OF THE INVENTION

The present invention has to do with a totally enclosed glue application system which is useful on many types of can labeling machines or machines for labeling similar products. Typical of machines on which the present invention may be used is a machine known as a "Burt" labeler manufactured by the Matur-Burt Company.

In this machine and many others, a continuous supply of cans to be processed is located at the in-feed area of the machine with the cans on their side. The machine must be adjusted to accommodate a particular size of can being labeled. The cans are then rolled through the machine and glue is applied to the can and this part of the can later makes contact with the front edge of the label. As the can continues to roll, glue is applied to the rear edge of the label and sealed around the can while the can is in its rolling motion. The can then passes through the machine to discharge for packaging.

The application of glue on the can to seal the front edge of the label is conventional and does not constitute a part of the present invention. The novelty of the present invention resides in the application of glue to the rear edge of the label in conjunction with a control system disclosed herein.

Conventionally, glue has been applied to the rear edge of a label by means of a tension loop in the form of a spring or rubberized belt. The applicator (spring or belt) passes through an open glue pot and picks up paste-like adhesive. It then passes through a striker to remove any excess adhesive. The applicator spans from the striker (located directly above the glue pot) to an idler pulley on the opposite side of the machine and then back across to the glue pot. When a can passes through the gluing station, it depresses two small levers which cause the moving applicator to touch the rear edge of the top label in the label stack. Since the front edge of the top label in the label stack is already attached to the can at this point, it is pulled from the stack immediately after the applicator deposits glue on its rear edge as the can rolls past the gluing station. The rear edge of the label is then glued to the front edge as it is wrapped around the can.

This type of application is defective in that much glue is wasted, the bond is poor, the operation is messy and the glue, which is in an open pot, is subject to contamination from the environment. Additionally, the spring or belt must run continuously through the glue and over the stack of labels during any delays in feeding cans through the machine and this causes unnecessary wear and breakage of the spring. Furthermore, on certain machines constant movement across the stack of labels produces cutting as well as excessive deposits of glue and the excess glue tends to flow over the other labels in the stack.

The present invention provides an improvement in that a clean and fully enclosed pressurized glue system is provided which can be applied to new equipment or to existing machines in the field. This system consists of a pressurized glue tank with related equipment and an electronic control unit which are in and of themselves old, together with a specially designed applicator system. The electronic control and photoelectric sensor predetermine the correct time and amount of adhesive to be applied to the rear edge of the label while the can is proceeding through the machine. Since the label is fed from a large stack, the possibility of glue saturating the remaining labels in the stack or running down the sides, which would cause label tearing and poor application, is eliminated. The glue applicator is in contact with the stack of labels at all times and is of a material and shape to permit it to conform to the convex shape of the stack which is generally the result of the printing on the label. A simple and quick disconnect arrangement of the applicator tube is provided so that the applicator tube may be flushed with water for cleaning during shut-down periods.

DETAILED DESCRIPTION

Since the invention involved here is related specifically to the method of applying glue to the rear edge of the label, other parts of the machine will be described only in a general way. Various portions of the system are conventional and will not be described in detail.

Figure 1:
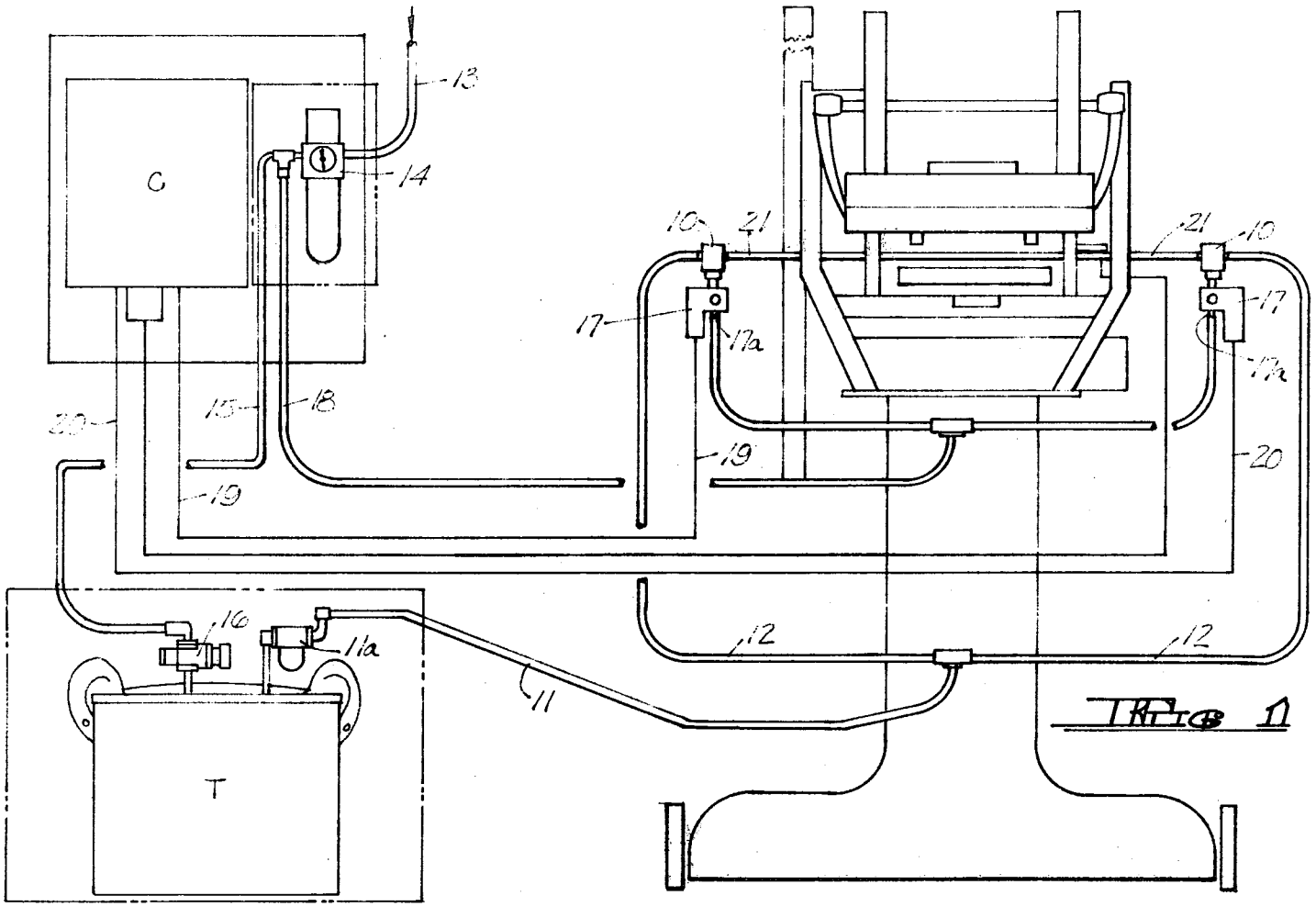
FIG. 1 is a schematic diagram of the complete glue application system including the glue source, the control and the applicator.

Referring first to FIG. 1, a conventional totally enclosed pressurized tank system is indicated at T. The pressure system provides glue to the two valves 10 which are located on each side of the machine, by way of the ports 10*a*. The glue is fed from the tank T through the line 11 to the lines 12 and thence to the valves 10. Pressure for the glue tank T is provided from plant pressurized air through a line 13, through an air regulator and filter 14 and through a line 15 and the air regulator 16 to the tank T. The glue from the tank passing to the line 11 passes through a glue filter 11*a*. A control box is diagrammatically indicated at C . The parts described thus far as conventional.

Each of the glue valves 10 is connected to an electrically operated air valve 17. The air valves 17 are conventional three way valves. The valves are provided with compressed air at regulated pressure at the ports 17*a* from a line 18 which is a branch from the line 15. The control box C contains a solid state electronic control system which provides an electric signal to the valves 17 through the leads 19 and 20.

Figures 2A, 2B:
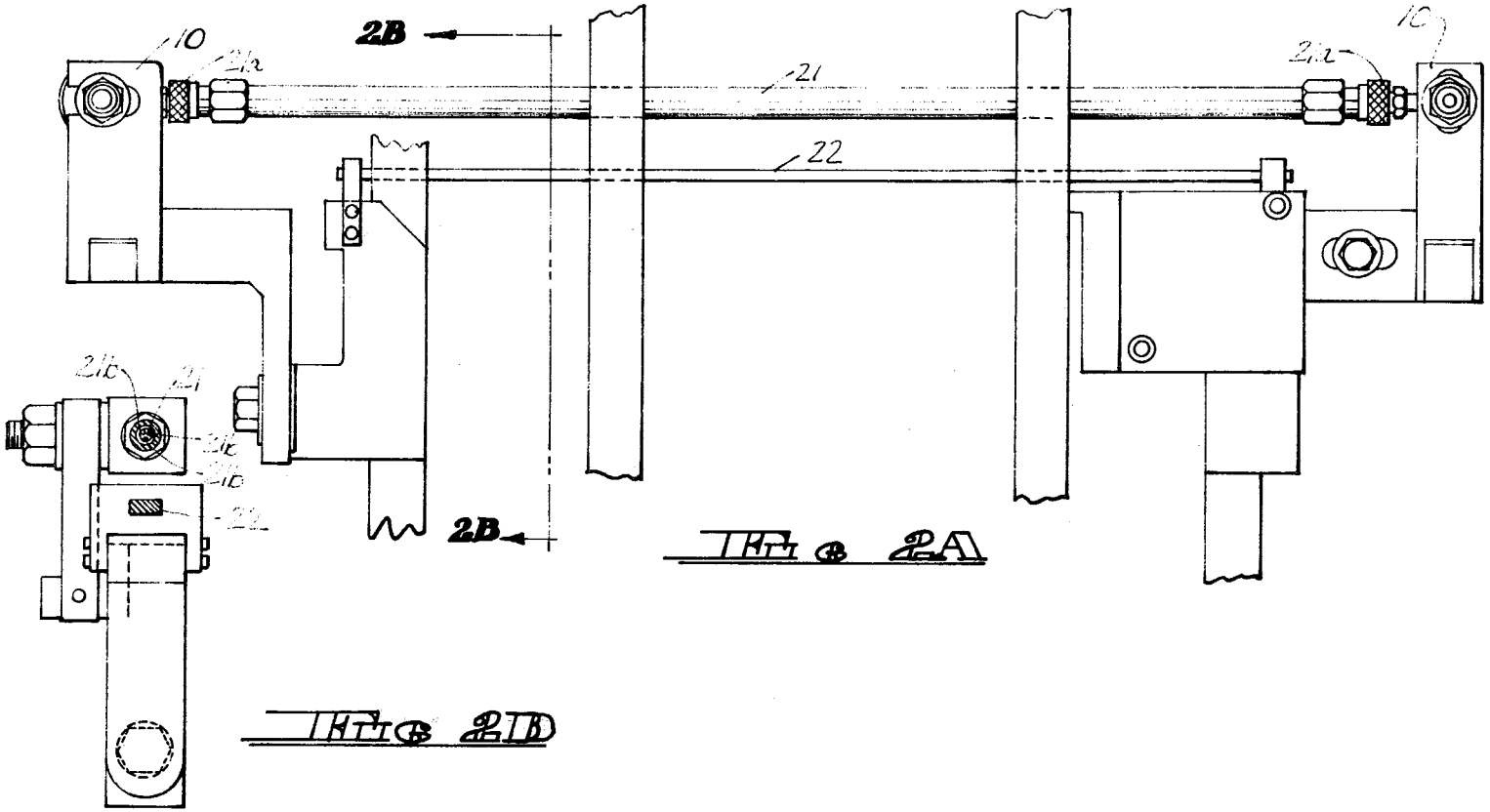
FIG. 2A is a fragmentary plan view of the applicator, quick disconnect elements and bracketing.
FIG. 2B is a cross sectional view taken on the line 2B—2B of FIG. 2A.
Figure 4:
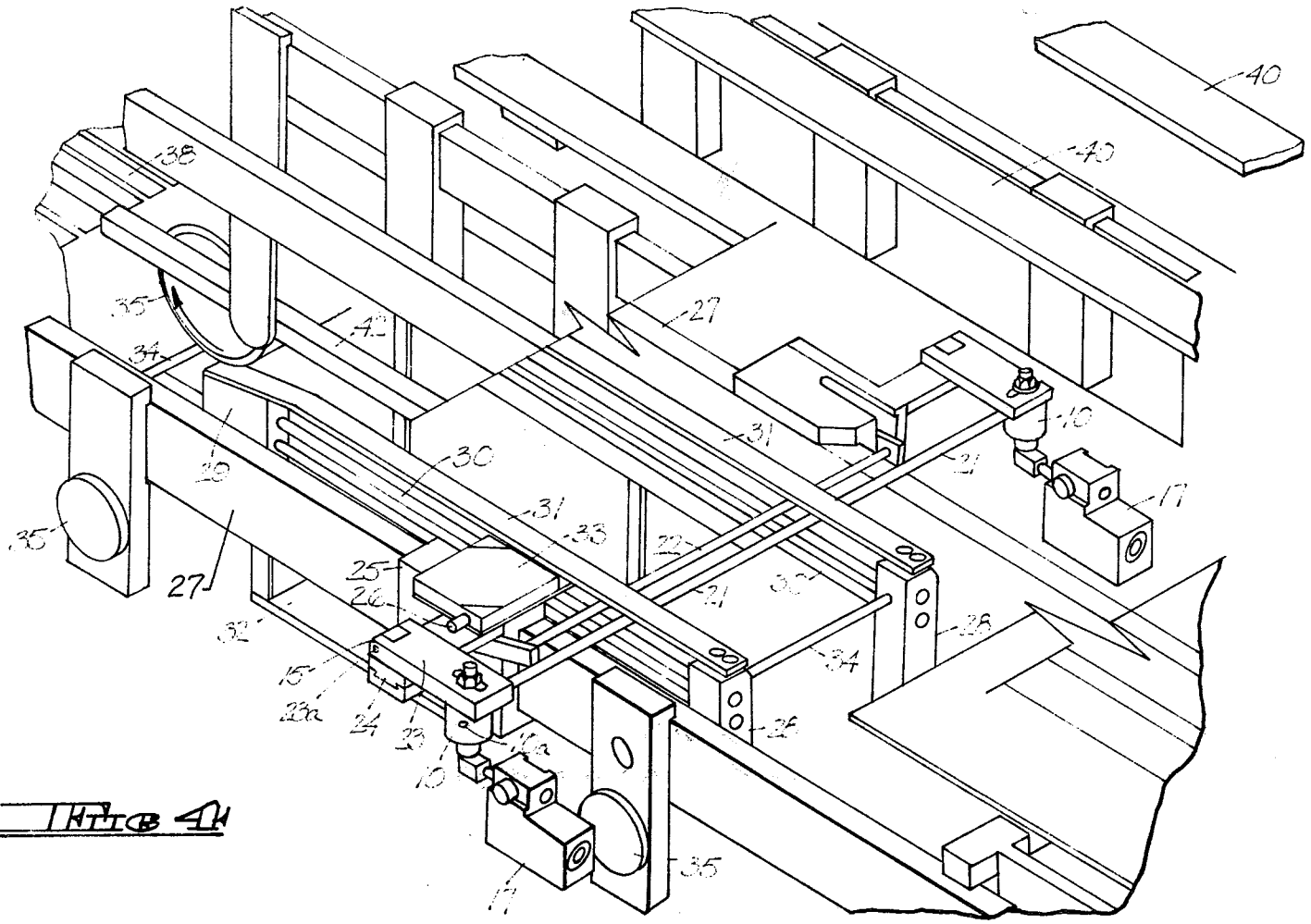
FIG. 4 is an enlarged fragementary view similar to FIG. 3 showing in greater detail the part of the apparatus which constitutes the present invention.

A glud applicator tube is indicated at 21 and it has perforations through which the glue issues, and the applicator tube 21 is connected to the valves 10 by means of quick disconnectors which in and of themselves are well known. These quick disconnectors may be seen at 21*a* in FIG. 2A. If it is desired to clean the glue applicator tube 21, or when the machine is to be shut down, the glue applicator tube can be quickly and simply removed from the valves 10 by means of the quick disconnectors 21*a* and then flushed to remove the glue before it has a chance to set up. As best seen in FIG. 2A a wiper or curling bar 22 extends approximately the length of the applicator tube 21. The purpose of this bar will be described later. Referring to FIG. 4, each glue valve 10 is mounted on a lever 23 which is pivoted at 23*a* to a bar 24 which is secured to the bracket 25 and 26. This bracket is slidably supported on the rail 27. A similar assembly or parts is provided on the opposite side of the machine and supported on another rail 27. By this arrangement all of the parts can be moved together as a unit. The mounting of the glue valves to the levers described above makes for easy removal of the glue valves. Slots are provided in the levers 23 and the bar 24 for necessary adjustment and alignment. The blocks 28 and 29 on each side of the machine are slidably mounted on the rods 30, and rails 31 which are secured to these blocks support the can as it rolls into position for glue application.

A label feed rack is indicated at 32 and an electronic sensor at 33 and these are also supported on the above mentioned rods so that they also move lengthwise of the machine as a unit. This adjustment is provided to accommodate different diameter cans or bottles, and also length of labels. Worm screws 34 in conjunction with the blocks 28 and 29 are operated by the knobs 35 to provide for lateral adjustment of the rails 31 and related parts to accommodate different can heights or lengths. The labels are stacked in the rack 32 which is smoothly raised by mechanical means during operation, in conformity with usage of the labels.

A hot glue pot 36 (FIG. 3) having a hopper 37 is supported across the other end of the machine frame at the feed end thereof. A series of rails 38 extending lengthwise over the glue pot 36 provide openings for the rollers 39 which are of such diameter as to rotate in the pot of glue and extend through the openings between the rails 38 to apply the glue to the can as it rolls over these rails. A pair of belts 40 driven by pulleys 41 engage the cans at the feed end and convey them through the machine in a rolling of rotational movement. Rails 42 at each side are near the ends of the cans to guide them in their travel through the machine.

As a can is engaged by the belts 40 at the feed end of the machine it is rolled over the rails 38 and the glue rollers 39, which apply a line of glue dots axially of the can. The rails 31 and the label and feed rack 32 have been adjusted so that the glue deposited on the can will contact the leading edge of the top label as the can rolls into position. The label is thus picked up as it adheres to the can while the opposite end is held down by the applicator tube 21. As a can and the label roll over the rails 31, they pass the sensor 33 which produces a signal to the electronic control unit C which has been set for a predetermined time. This in turn actuates the air valves 17 causing the glue valves 10 to open for the time period set. Glue is fed in from both ends into the applicator tube and is discharged through perforations in the tube 21 onto the rear edge of the label. All of this takes place at the precise moment that the can is ready to pull the label from under the tube 21 and wiper bar 22. As this occurs, the glue is troweled onto the label and its edge is curled as it leaves the tube. As the can continues to roll in contact with the belts, the rear edge of the label contacts the can and is secured thereto. The can then continues to the discharge end of the machine for packaging.

Figure 3:
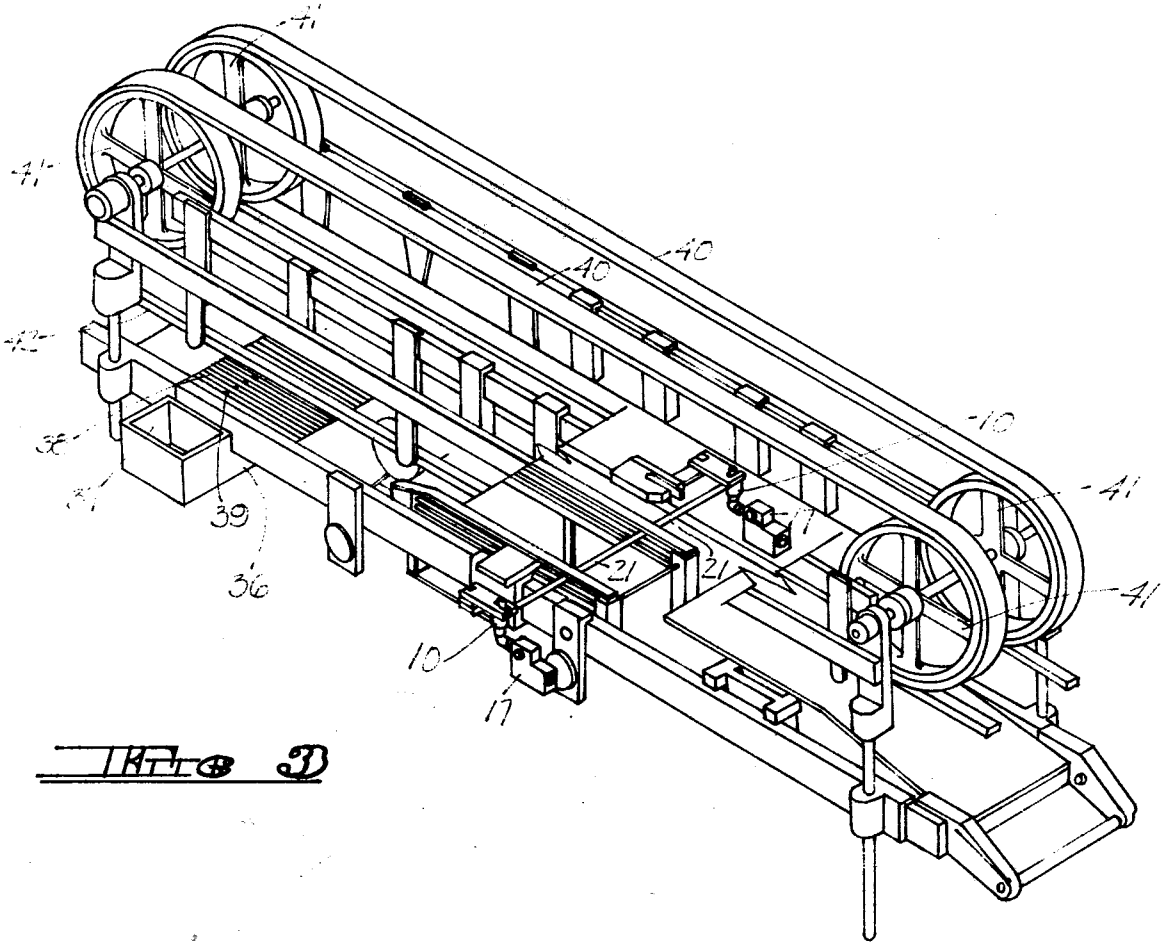
FIG. 3 is an isometric general view of a type of can labeling machine with the glue application system of the present invention.

The cans are continuously fed into the machine in close proximity to each other for proper label application and maximum production. The applicator tube is designed to follow the natural curvature of the label stack to insure perfect contact during glue application. Because of the length of the applicator tube and because of the high speed of operation, it is necessary to admit glue at each end in order that even distribution of glue may be provided. The perforations in the applicator tube are preferably positioned facing slightly toward the feed end of the machine, i.e. toward the left as seen in FIGS. 3 and 4, for proper glue discharge. This position of the perforations is maintained through one of the quick disconnectors 21*a* as best seen in FIG. 2B where spline-like devices 21*b* are provided to orient the tube 21 in its proper position.

Thus, the positioning of the perforations, combined with the controlled glue discharge assuring a correct amount of glue, provide for clean, trouble-free operation.

It will be understood that modifications may be made without departing from the spirit of the invention and therefore no limitation not specifically set forth in the claims is intended and no such limitation should be implied.

What I claim is:

1. In a labeling machine for cylindrical objects having means to apply glue to such an object in a line parallel to the axis thereof, and means for causing such object to roll over a stack of labels such that one end of the uppermost label in the stack is picked up by adhering to said line of glue on the object, and is rolled around the can as the can progresses in its rolling path; a glue applicator tube having a row of apertures for application of glue, said tube being oriented with the row of apertures facing slightly toward the feed end of the apparatus, said tube being disposed in contact with the other end of the uppermost label in the stack, a glue valve at each end of said applicator tube, means for supplying glue under pressure to said valves, sensing means to detect the passage of said cylindrical object, and control means responsive to said sensing means to cause said glue valves to open for a predetermined period of time, to apply a line of glue to the trailing end of said uppermost label, to cause it to adhere to said cylindrical body.

2. Apparatus according to claim 1 wherein said glue valves are mounted on pivoted brackets, said brackets in turn being mounted on transverse rails, whereby said brackets and glue valves may be moved as a unit.

3. Apparatus according to claim 2 wherein said glue valves are connected to the glue supply by means of quick disconnectors, and the pivoted mounting of said brackets facilitates removal of the glue valves for cleaning or replacement.

4. Apparatus according to claim 1 wherein parallel rails are provided to support the object as it rolls over the label stack, said rails being secured to blocks which are slidably mounted on rods longitudinally of the apparatus, and a rack for holding the stack of labels, and the sensing device being also supported on said rods, so that said rails, rack and sensing device can move as a unit lengthwise of the apparatus to accommodate different diameter objects and different lengths of labels.

5. Apparatus according to claim 1 wherein the orientation of said glue applicator tube is maintained by a splined connection ton one, at least, of said quick disconnectors.

6. Apparatus according to claim 1, wherein said applicator tube is of a shape and material permitting it to conform to the shape of the labels in said stack, whereby to maintain contact with the top label in said stack throughout its length.

* * * * *